United States Patent [19]

Passmore

[11] Patent Number: 4,859,239

[45] Date of Patent: Aug. 22, 1989

[54] TUNGSTEN ELECTRODE AND METHOD OF PRODUCING SAME

[75] Inventor: Edmund M. Passmore, Gloucester, Mass.

[73] Assignee: GTE Products Corporation, Danvers, Mass.

[21] Appl. No.: 287,183

[22] Filed: Dec. 20, 1988

[51] Int. Cl.[4] ..... C22C 29/12

[52] U.S. Cl. ..... 75/235; 75/248; 148/126.1; 148/127; 148/133; 204/291; 204/292; 419/19; 419/26; 419/29; 419/54

[58] Field of Search ..... 75/235, 248; 419/19, 419/26, 29, 54; 148/126.1, 127, 133; 204/291, 292

[56] References Cited

U.S. PATENT DOCUMENTS

| | | | |
|---|---|---|---|
| 4,155,757 | 5/1979 | Hing | 75/232 |
| 4,155,758 | 5/1979 | Evans et al. | 75/232 |
| 4,678,718 | 7/1987 | Wang | 419/4 |

*Primary Examiner*—Stephen J. Lechert, Jr.
*Attorney, Agent, or Firm*—Martha Ann Finnegan

[57] ABSTRACT

An electrode, and method of producing same, including tungsten which has been heated in wet hydrogen at 1050° C. for 5 to 10 minutes, then heated at about 1500° C. for about three hours in a vacuum, and then further heated at about 2800° C. for about 5 minutes in a vacuum.

13 Claims, 1 Drawing Sheet

TUNGSTEN ELECTRODE AND METHOD OF PRODUCING SAME

BACKGROUND OF THE INVENTION

1. Field of the Invention

The present invention relates to an improved tungsten electrode for a metal halide lamp and to an improved method of making the same.

2. Description of the Prior Art

Tungsten electrodes for use in metal halide lamps are well known in the art. Such tungsten electrodes are typically used in metal halide high intensity discharge lamps. In the production of tungsten electrodes, it is known to subject the electrodes to a heat treatment in the presence of wet hydrogen. It is also known to subject tungsten electrodes to a vacuum thermal treatment. It is known to treat tungsten electrodes (1) for 30 minutes at 1500° C., (2) for 10 minutes at 2000° C., and (3) at temperatures as high as 2800° C.

In one known industrial process, tungsten electrodes are produced by first mixing a small amount of thoria powder, such as, for example, about 1% thoria powder, with tungsten powder and then cold pressing the mixture into a rod-like billet which is sintered at about 2100° C. in hydrogen. After further processing to obtain individual electrodes, such electrodes are subjected to a wet hydrogen fire for about 5 to 10 minutes at about 1050° C.

The foregoing process is known in the art. Such process produces acceptable tungsten electrodes for high intensity discharge metal halide lamps. However, it is an object of the present invention to provide an improved tungsten electrode. It is also an object of the present invention to provide a tungsten electrode which is more uniform than that produced heretofore. It is another object of the present invention to provide a tungsten electrode for use in a metal halide lamp having improved light output or luminous efficacy. It is a further object of the present invention to provide a tungsten electrode for use in a metal halide lamp having improved lumen maintenance during the life of the lamp.

SUMMARY OF THE INVENTION

The invention achieves these and other results by providing a tungsten electrode produced by (1) providing a basic electrode comprising tungsten; (2) heating the basic electrode in wet hydrogen at about 1050° C. for about 5 to 10 minutes; (3) further heating the basic electrode at about 1500° C. for about three hours in a vacuum; and (4) further heating the basic electrode at about 2800° C. for about five minutes in a vacuum.

BRIEF DESCRIPTION OF THE DRAWINGS

The drawing is a block diagram representing the method of the present invention.

DESCRIPTION OF THE PREFERRED EMBODIMENT

Figure 1:
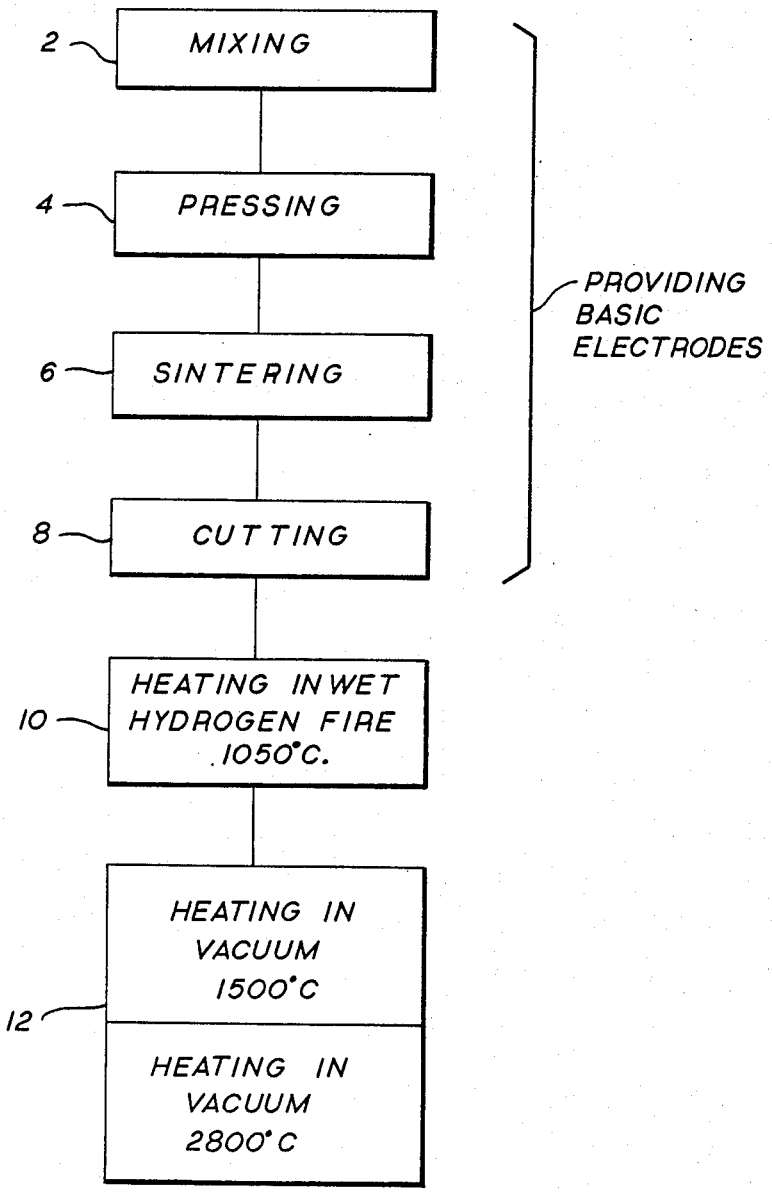

In the preferred embodiment a tungsten electrode is produced by first providing what is referred to herein as a basic electrode comprising tungsten. Such an electrode can be produced in any known manner. Referring to the drawing, the production of such a new electrode can include the steps of mixing 2, pressing 4, sintering 6, and cutting 8. For example, a basic electrode can be formed by cold pressing tungsten, such as for example, tungsten powder, and sintering the cold pressed tungsten powder to provide the desired material, from which a basic tungsten electrode can be formed as by, for example, cutting. Other material(s) can be mixed with the tungsten prior to cold pressing. For example, in the preferred embodiment, about 1% thoria powder is mixed with the tungsten powder, the resulting mixture being cold pressed into a rod-like billet having a generally square cross section. The rod-like billet is sintered in a known manner. For example, the ends of the billet can be engaged by electrical contacts and electrical current can be caused to pass therethrough to achieve the desired sintering temperature. The sintering is preferably effected in the presence of hydrogen at a temperature of about 2100° C. Such sintering increases the density of the billet. Such a sintering process is well known in the art. However, any other sintering process can be used, provided such process increases the density as required heretofore in tungsten electrodes known in the art. The resulting sintered billet can be rolled and swaged, to reduce its cross-section, and then drawn into a wire-like structure preferably having a diameter of about 17 mils. A plurality of such wire-like structures are bundled together, and the bundle is cut throughout its length to provide a plurality of mini-bundles from which individual short wire-like structures are separated to provide a plurality of individual electrodes which can have a length of about 0.295 inch. The electrodes are then tumbled in an abrasive such as, for example, aluminum oxide, to round the edges of the ends. The foregoing is a description of one manner by which to provide a basic electrode comprising tungsten. Such process is known in the art and no further description is deemed necessary for those skilled in the art to produce a basic electrode comprising tungsten. Although preferred, all of the foregoing steps are not required to provide a basic electrode comprising tungsten. Any other method can be used so long as an electrode comprising tungsten is provided having the known characteristics heretofore required of such an electrode. The present invention first provides such a known basic electrode comprising tungsten and then effects substantial operating improvements thereto by additional heating steps 10 and 12 as set forth below.

In particular, after providing the basic tungsten electrode, it is subjected to a wet hydrogen fire for about 5 to 10 minutes at 1050° C. in a known manner. The electrode is then subjected to further heating. In particular, the basic tungsten electrode is further heated at about 1500° C. for about three hours in a vacuum and then yet further heated at about 2800° C. for about 5 minutes in a vacuum. The heating at about 1500° C. for three hours is in a vacuum of about $2 \times 10^{-7}$ Torr, and the heating at about 2800° C. for about 5 minutes is in a vacuum of about $1 \times 10^{-6}$ Torr. The additional heating can be accomplished by conveying the electrode into a vacuum furnace while first heating the electrode at about 1500° C. for about three hours in a vacuum and then raising the temperature in the furnace to further heat the electrode at about 2800° C. for about 5 minutes in a vacuum. To this end, any known vacuum furnace capable of operating at such high temperatures and providing such a vacuum can be used. In the preferred embodiment a vacuum furnace comprising a cryogenic vacuum pump backed up by a molecular sieve pump; that is, one such pump in series with the other, is particularly useful in effecting the objects of the present invention. Such a furnace is generally known in the art and is particularly useful in that there is no source of carbon or oil vapor. It has also been found useful to use tungsten mesh heating elements in the furnace and to convey the basic electrode into the furnace in a tungsten crucible. In such a furnace, the crucible and electrodes therein are heated by passing current through the tungsten mesh heating elements in a known manner. In the process, the first temperature of 1500° C. is held for three hours and the temperature is then elevated to 2800° C. of 5 minutes as the tungsten crucible having the electrodes therein is held within the furnace.

The improved process described herein produces an electrode useful, for example, in a metal halide lamp. Examples of such a metal halide lamp are described in U.S. Pat. Nos. 4,415,829, 4,620,125 and 4,625,141. The electrode of the present invention comprises tungsten which has been heated in wet hydrogen at about 1500° C. for about 5 to 10 minutes, then heated at about 1500° C. for about three hours in a vacuum of $2 \times 10^{-7}$ Torr, and then further heated at about 2800° C. for about 5 minutes in a vacuum of $1 \times 10^{-6}$ Torr. In the preferred embodiment the electrode also includes a sintered mixture of tungsten powder and thoria powder, wherein preferably there is about 1% thoria powder.

It has been observed that high intensity discharge metal halide lamps having 1% thoriated tungsten electrodes, which have also been subjected to the improved process described herein, are an improvement over prior art lamps having 1% thoriated tungsten electrodes without such additional processing. In Particular, such lamps having the improved electrodes of the present invention exhibit improved light output or luminous efficacy as well as improved lumen maintenance during the life of the lamp. In addition, such improved lamps exhibit less variation in light output and therefore a more uniform product having a more reproducible light output can be produced.

The embodiments which have been describe herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. The method of making a tungsten electrode comprising the steps of:

providing a basic electrode comprising tungsten;

then heating said basic electrode in wet hydrogen at about 1050° C. for about 5 to 10 minutes;

then further heating said basic electrode at about 1500° C. for about three hours in a vacuum; and then further heating said basic electrode at about 2800° C. for about 5 minutes in a vacuum.

2. The method of claim 1 wherein said further heating at about 1500° C. for about three hours is in a vacuum of about $2 \times 10^{-7}$ Torr, and said further heating at about 2800° C. for about five minutes is in a vacuum of about $1 \times 10^{-6}$ Torr.

3. The method of claim 1 wherein said step of providing said basic electrode comprises mixing tungsten powder and thoria powder as constituents of said basic electrode.

4. The method of claim 3 wherein said step of providing said basic electrode comprises sintering said constituents of said basic electrode at about 2100° C.

5. A method of making a tungsten electrode comprising the steps of:

providing a basic electrode comprising tungsten;

then heating said basic electrode in wet hydrogen at about 1050° C. for about 5 to 10 minutes; and then heating said basic electrode in a vacuum furnace while firs further heating said basic electrode at about 1500° C. for about three hours in a vacuum and then raising the temperature in said vacuum furnace and further heating said basic electrode at about 2800° C. for about 5 minutes in a vacuum.

6. The method of claim 5 wherein said heating at about 1500° C. for about three hours is in a vacuum of about $2 \times 10^{-7}$ Torr, and said further heating at about 2800° C. for about 5 minutes is in a vacuum of about $1 \times 10^{-6}$ Torr.

7. The method of claim 5 further including the step of depositing said basic electrode within a tungsten crucible after step (2) and wherein said conveying step (3) includes conveying said tungsten crucible and said basic electrode therein into said vacuum furnace.

8. The method of claim 7 wherein said heating at about 1500° C. for about three hours in in a vacuum of about $2 \times 10^{-7}$ Torr, and said further heating at about 2800° C. for about 5 minutes is in a vacuum of about $1 \times 10^{-6}$ Torr.

9. The method of claim 8 wherein said step of providing said basic electrode comprises mixing tungsten powder and thoria powder as constituents of said basic electrode.

10. The method of claim 9 wherein said step of providing said basic electrode comprises sintering said constituents of said basic electrode at about 2100° C.

11. An electrode comprising tungsten which has been heated in wet hydrogen at about 1050° C. for about 5 to 10 minutes, then heated at about 1500° C. for about three hours in a vacuum, and then further heated at about 2800° C. for about 5 minutes in a vacuum.

12. The electrode of claim 11 comprising a sintered mixture of tungsten powder and thoria powder.

13. The electrode of claim 12 comprising about 1% thoria powder.

* * * * *